United States Patent [19]

Cressi

[11] 4,171,543

[45] Oct. 23, 1979

[54] MASK FOR SKIN-DIVING

[75] Inventor: Leopoldo A. Cressi, Genova-Quinto, Italy

[73] Assignee: Cressi-Sub S.p.A., Genova-Quinto, Italy

[21] Appl. No.: 864,040

[22] Filed: Dec. 23, 1977

[30] Foreign Application Priority Data

Mar. 23, 1977 [IT] Italy ..... 12523 A/77

[51] Int. Cl.[2] ..... A61F 9/02

[52] U.S. Cl. ..... 2/428; 2/429; 2/452

[58] Field of Search ..... 2/428, 429, 430, 426, 2/452, 439, 440, 441

[56] References Cited

U.S. PATENT DOCUMENTS

| | | | |
|---|---|---|---|
| 3,323,135 | 6/1967 | Miller | 2/429 |
| 3,605,204 | 9/1971 | Amundsen | 2/452 X |
| 3,908,196 | 9/1975 | Ferraro | 2/428 |

*Primary Examiner*—Peter Nerbun

*Attorney, Agent, or Firm*—Allison C. Collard; Thomas M. Galgano

[57] ABSTRACT

An improved diving mask includes a rubber body configured to mate with the user's face, a viewing lens having a mounting frame extending about and secured to its rim and a fairing body which substantially encompasses the rubber body and is configured for snap-fit engagement with the mounting frame with the forward edge of the rubber body sealingly engaged between the fairing body and mounting frame. The assembly is designed to maximize the visual field and means are also provided for quick and regulatable connection with a rear holding-strap.

6 Claims, 6 Drawing Figures

Fig.1
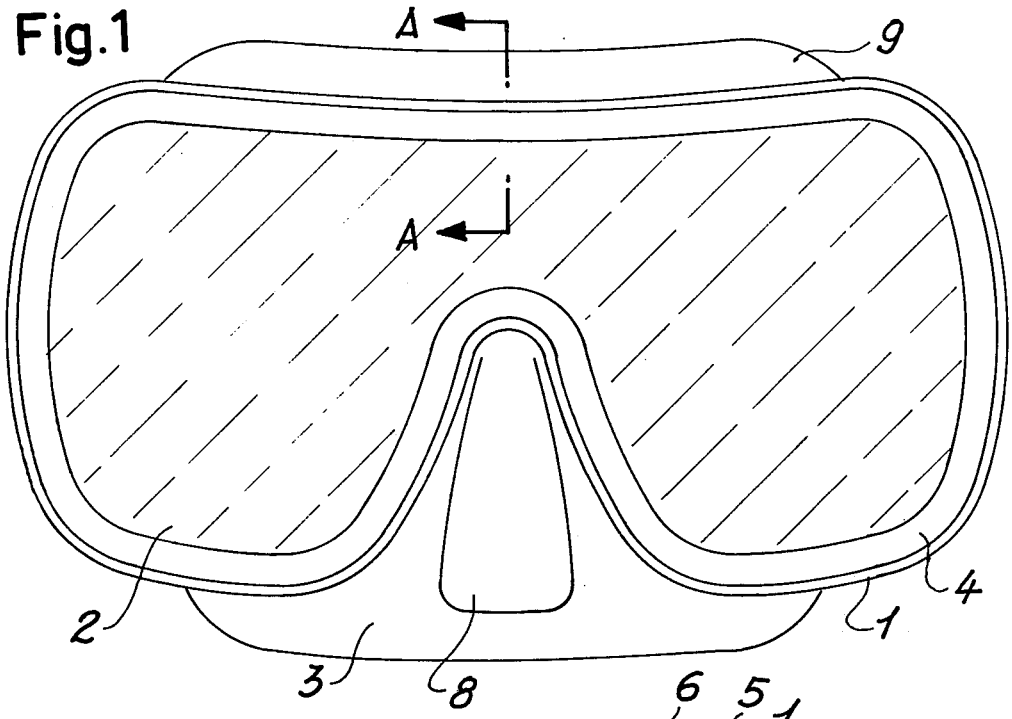
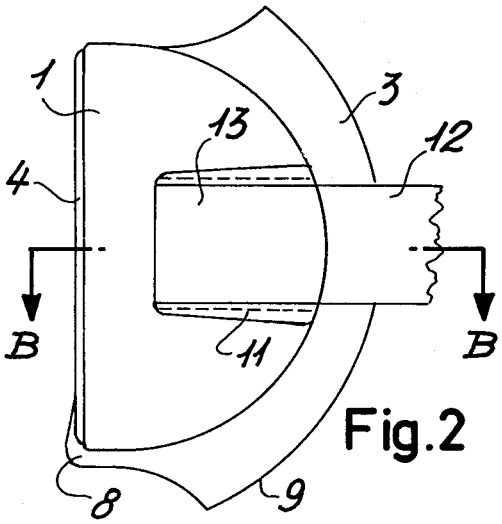
Fig.2
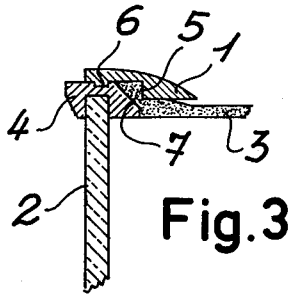
Fig.3
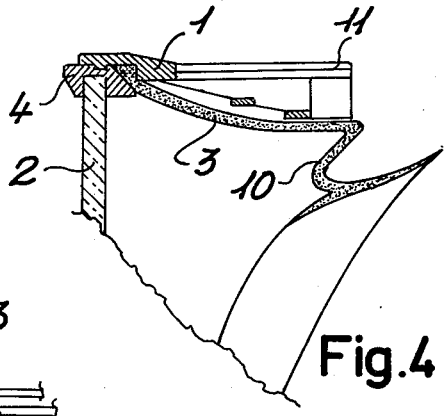
Fig.4
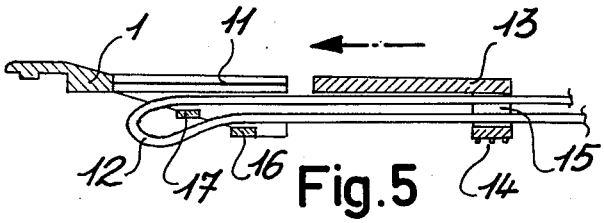
Fig.5
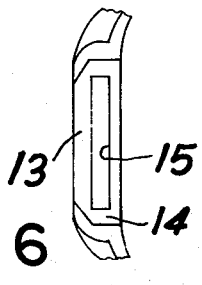
Fig. 6

MASK FOR SKIN-DIVING

In the field of skin-diving, many types of masks are known, the most improved of which are so designed as to conform to any facial configuration, and also comprise a nose-embracing portion formed in the rubber member constituting the body of the mask. The sight-glass or viewing lens of these masks has such a configuration as to ensure a very wide visual field, while the overall dimensions are so designed as to minimize the internal volume of the mask. Despite these improvements, the practical use of these masks in long and difficult conditions still evidences many drawbacks. These drawbacks often cause seepage of water in the area of contact between the glass, rubber body and pressure ring, and also at the area of contact between the rubber body and the user's face due to non-perfect conformation characteristics of the rubber body. Other drawbacks affect the regulatable connection of the holding-strap, and the assembling steps of some components. Finally, the appearance seems to need improvements as well.

The mask according to the invention is the result of an accurate study to overcome these drawbacks, and is considerably distinguished from the most advanced models of known masks.

Thus, in accordance with the present invention, an improved diving mask is provided which includes a generally tubular rubber body including a forward end portion having an integrally-formed nose-embracing portion and a rearward end portion configured to embrace the user's face and a viewing lens. A mounting frame surrounds and is secured to the rim of the lens. The frame has an outer peripheral surface, the forward portion of which has a generally annular-shaped channel formed therein and the rearward portion of which is rearwardly and inwardly conically-tapered. A generally tubular fairing body is configured to surround and embrace a substantial portion of the rubber body. The fairing body has a generally annular-shaped projection extending inwardly from its inner peripheral surface, adjacent to the forward edge thereof, configured and dimensioned for snap-fit engagement with the channel of the frame. The inner peripheral surface of the fairing body also has an inwardly offset step formed rearwardly of the projection providing a seat on which the forward edge of the rubber body may rest. The step is disposed to cooperate with the conically tapered rearward portion of the frame upon snap-fit engagement of the projection of the fairing body with the channel of the frame, so as to sealingly secure the forward edge of the rubber body therebetween.

Other objects and features of the present invention will become apparent from the following detailed description when taken in connction with the accompanying drawing which discloses a single embodiment of the invention. It is to be understood that the drawing is designed for the purpose of illustration only, and is not intended as a definition of the limits and scope of the invention disclosed.

In the drawing, wherein similar reference numerals denote similar elements throughout the several views:

FIG. 1 is a front elevational view of the mask according to the invention;

FIG. 2 is a side elevational view of the mask shown in FIG. 1;

FIG. 3 is a fragmentarily-illustrated vertical sectional view, taken along line A—A of FIG. 1, showing the area of watertight connection between the sight-glass, rubber body and pressure ring, the latter member being shaped as a fairing member according to an important feature of the invention;

FIG. 4 is a fragmentary-illustrated horizontal sectional view, taken along line B—B of FIG. 2, with the strap connecting means and strap removed and showing the special configuration of the edge of the rubber body designed to mate with the user's face;

FIG. 5 is sectional view taken along line B—B of FIG. 2, but showing the strap with the strap connecting means being moved to a locking position and FIG. 6 is an end view of the strap connecting means inserted within a dovetail seat provided in the fairing body side embossment.

With particular reference to FIGS. 1 and 2 of the drawing, it will be noted that the usual pressure member, the so-called ring member, is replaced by a shaped fairing body 1 that will function as the main structure and lining-casing of the mask according to the invention. Body 1, made preferably of a somewhat rigid plastic material, though it can be made also of metal or other material, has a generally closed ring configuration, and does not employ screws, hooks or the like for mounting. Instead, the watertight connection with the sight-glass 2 and rubber body 3 is achieved by a special configuration of the front connecting portion of body 1 and with the aid of a conical-contoured frame 4, which is preferably molded directly around sight-glass 2 so as to form a unitary body therewith. However, it is to be noted that it is possible to form the conical contour directly on the rim of glass 2. As particularly shown in FIG. 3, the watertight connection is effected as follows: the front edge of fairing body 1 has an inside undercut seat with a shoulder 5 and a slightly projecting annular rim 6 serving as a retaining member for snap-connection. The corresponding edge of the rubber body 3 is suitably configured and has a front conical edge portion which complements the conical contour of frame member 4, and particularly the conical portion 7 thereof. These two parts cooperate to form a conical edge sealing system. More particularly, upon assembling, conical portion 7 presses rubber body 3 against the bottom of seat 5 in the fairing body 1. Therefore, this system simultaneously affords a firm connection of the glass-and-frame assembly with fairing body 1 and rubber body 3, as well as a perfect water-tightness between all members, with no need of locking screws or the like that slow down the assembling operations, particularly in the case of mass-production.

Rubber body 3 which includes an integral nose-embracing portion 8, is so shaped that the outer surface thereof contacts against the inner surface of fairing body 1. The edge 9 thereof extends rearwardly to mate with the user's face. This edge is a unitary molded member and, according to another feature of the invention and as shown at 10 in FIG. 4, may have a bellows shape, with two or more plies; this ensures a soft contact with the face, helps withstand the water-pressure, and ensures a perfect mating under any circumstances. Due to the conical edge sealing system according to the invention, the rubber body is not required to enwrap, as heretofore needed, the outer edge of the sight-glass, and this feature is a further simplification of both the molding and assembling steps. Finally, inasmuch as the outer surface of the rubber body rests against the inner surface of fairing body 1, rubber body 3 can be made of a more soft mixture and with thinner walls, so as to ensure an improved sealing effect both on the front side (where the rubber body functions as a sealing gasket) and on the rear side (where the bellows-supported edge must conformingly rest on the user's face).

Another improvement according to the invention relates to the system for connecting the rear strap to the mask, which system has the particular advantage of eliminating the usual buckles and other connecting means. As shown in FIGS. 2, 4 and 5, according to the invention, fairing body 1 is formed on both sides with a carefully merged embossment 11. Embossment 11 is provided with a suitable recessed slit, as wide as the strap 12, and has a dovetail seat in both sides whereinto a closure and locking member 13 can be slidably inserted. Closure and locking member 13 is provided, on the inner side thereof, with a bridge member 14 and a slot 15 through which the return stretch of the strap 12 is passed. Before the return stretch, the strap passes over a bridge member 16 and around a bridge member 17, both formed internally within embossment 11. After passing the strap as described and placing it in the desired position, the locking thereof can be obtained by completely inserting locking member 13 into the dovetail seat in embossment 11. Upon completion of this operation, the surface of fairing body 1 will be substantially evenly smooth and free of projections. In order to change the positioning of the strap, locking member 13 will just be removed from its seat, whereupon the strap can be repositioned as desired. Closure and locking member 13 can be made of plastic or any other suitable material.

While only one embodiment of the present invention has been shown and described, it will be obvious to those persons of ordinary skill in the art that many changes and modifications may be made thereunto without departing from the spirit and scope of the invention.

What is claimed is:

1. An improved diving mask comprising:

a generally tubular rubber body including a forward end portion having an integrally-formed nose-embracing portion and a rearward end portion configured to embrace the user's face;

a viewing lens;

a mounting frame surrounding and secured to the rim of said lens, said frame having an outer peripheral surface, the forward portion of which has a generally annular-shaped channel formed therein and the rearward portion of which is rearwardly and inwardly conically-tapered; and a generally tubular fairing body configured to surround and embrace a substantial portion of said rubber body, said fairing body having a generally annular-shaped projection extending inwardly from its inner peripheral surface, adjacent to the forward edge thereof, configured and dimensioned for snap-fit engagement with said channel of said frame, said inner peripheral surface of said fairing body also having an inwardly offset step formed rearwardly of said projection providing a seat on which the forward edge of the rubber body may rest, said step being disposed to cooperate with said conically tapered rearward portion of said frame upon snap-fit engagement of said projection of said fairing body with said channel of said frame, so as to sealingly secure said forward edge of said rubber body therebetween.

2. The mask according to claim 1, wherein said forward edge of said rubber body has a rearwardly and inwardly conically tapered peripheral portion configured and dimensioned to complement said conically tapered rearward portion of said frame so as to ensure a watertight engagement therewith and wherein said rearward end portion of said rubber body is provided with a bellows-like member including at least two reversely-folded interconnected and articulated plies, adjacent to the rearward edge thereof.

3. The mask according to claim 1, wherein said lens and frame comprise a one-piece, integrally-formed construction.

4. The mask according to claim 1, wherein said fairing body has two integrally-molded embossments formed on the outer surface thereof, each of which is disposed adjacent to one of the lateral sides of the lens, said embossments each having a slit formed therethrough for threading a strap therethrough, each of said embossments also having a dove-tail shaped seat, and wherein said mask additionally includes two closure and locking members, each of which is slidably insertable in the dovetail seat of one of said embossments, said members each being provided with a bridge member spaced from the inner side thereof, defining a slit through which the return stretch of the strap may be passed.

5. The mask according to claim 5, wherein said fairing body, adjacent to each of said embossments, is provided on the inner side thereof with two bridge members, spaced therefrom around which the strap is passed.

6. The mask according to claim 1, wherein said fairing body is made from a relatively rigid plastic material.

* * * * *